United States Patent [19]

Hayakawa et al.

[11] Patent Number: 5,009,977

[45] Date of Patent: Apr. 23, 1991

[54] PHOTOSENSITIVE MEMBER FOR ELECTROPHOTOGRAPHY HAVING AMORPHOUS SILICON

[75] Inventors: Takashi Hayakawa, Nara; Shiro Narikawa, Kashihara; Kunio Ohashi, Nara; Yoshiharu Tsujimoto, Yamatokoriyama, all of Japan

[73] Assignee: Sharp Kabushiki Kaisha, Osaka, Japan

[21] Appl. No.: 369,473

[22] Filed: Jun. 21, 1989

[30] Foreign Application Priority Data

Jun. 28, 1988 [JP] Japan ..... 63-161978
Jun. 29, 1988 [JP] Japan ..... 63-161209
Jun. 29, 1988 [JP] Japan ..... 63-161210

[51] Int. Cl.[5] ..... G03G 5/085

[52] U.S. Cl. ..... 430/84; 430/95; 430/128

[58] Field of Search ..... 430/58, 78, 84, 95, 430/60, 66, 128, 131, 132

[56] References Cited

U.S. PATENT DOCUMENTS

| | | | |
|---|---|---|---|
| 4,265,991 | 5/1981 | Hirai et al. | 430/64 |
| 4,405,702 | 9/1983 | Shirai et al. | 430/60 |
| 4,471,042 | 9/1984 | Komatsu et al. | 430/64 |
| 4,532,199 | 7/1985 | Ueno et al. | 430/128 |
| 4,705,732 | 11/1987 | Saitoh et al. | 430/57 |
| 4,760,008 | 7/1988 | Yamazaki et al. | 430/127 |
| 4,797,338 | 1/1989 | Iino et al. | 430/58 |

*Primary Examiner*—John Goodrow
*Attorney, Agent, or Firm*—Sandler, Greenblum & Bernstein

[57] ABSTRACT

A photosensitive member for electrophotographic photoreceptor, composed of an amorphous silicon containing carbon; nitrogen or oxygen and a specific amount of hydrogen and/or halogen, prepared by electron cyclotron resonance method, which is useful for xerographic systems.

18 Claims, 11 Drawing Sheets

PHOTOSENSITIVE MEMBER FOR ELECTROPHOTOGRAPHY HAVING AMORPHOUS SILICON

BACKGROUND OF THE INVENTION

1. Field of the Invention

The invention relates to an electrophotographic photosensitive member used in electrophotographic imaging processes, and more particularly to a electrophotographic photoreceptor for xerographic systems.

2. Description of the Prior Art

Recently, an amorphous silicon nitride containing H, amorphous silicon carbide containing H or amorphous silicon oxide containing H, each hereinafter referred to as a-SiN, a-SiC or a-SiO photoconductive film, respectively, have been utilized for a photoconductive layer of an electrophotographic photoreceptor; namely, because photoreceptor composed of such photosensitive members show (1) long life, (2) are to men and (3) have photosensitivity.

a-SiN, a-SiC or a-SiO photoconductive film has been prepared by plasma CVD and sputtering methods, where H content in these films has been limited to be in the range of 10–40 atomic % (see U.S. Pat. No. 4,471,042).

Each of the a-SiN, a-SiC and a-SiO photoconductive films can achieve, only by prescribing the specific amount of N, C or O in the film and by with B, reach dark conductivity of about $10^{-13}\Omega^{-1}cm^{-1}$ to be usable a photosensitive member. While a-SiC and a-SiO photoconductive films have a lower dark conductivity, they simultaneously have lower photosensitivity, so that practical use has been hindered in this regard. Also, it has been demonstrated in the inventor's experiments that in repeated operation on next charging process after exposure or photo-discharge, the surface potential of a-Sin photoconductive film lowers 20% or more from an initial value. In other words, the conventional type photoreceptor using a-SiN film as a photoconcuctive layer is quite poor in dark decay characterisics to thereby not be suitable for practical use. This may be due to the fact that gap states such as dangling bond density of Si and the like increase due to the incorporation of N, so that carriers excited by exposure and photo-discharge will be trapped into the gap states and then will be released from them by the electric field applied on a next charging process thereby removing the surface charges.

In addition, the plasma CVD method or sputtering method has been adopted to prepare the conventional a-SiC, a-SiN and a-SiO photoconductive films, which inevitably caused to yield a polymeric powder of ($SiH_2$) on a film surface during deposition to thereby hinder a normal growth of film, and also needed a long time for the film formation due to low deposition rate thereof, to thereby remain a drawback for cost saving.

Besides, in the prior art, the a-SiC, a-SiO and a-SiN photoconductive films obstained do not possess sufficient photosensitivety to be used for electrophotographic photosensitive member and do not contain an H content of at least 40 atomic %.

A preparation method for amorphous silicon films utilizing the electron cyclotron resonance (ECR) method has been proposed (see U.S. Pat. No. 4,532,199).

SUMMARY OF THE INVENTION

A photosensitive member for electrophotography which comprises a conductive substrate and a photoconductive layer in which the photoconductive layer is an amorphous silicon containing 40–60 atomic % of hydrogen and/or halogen and at least one chemical modifier selected from carbon, nitrogen and oxygen, and fabricated by electron cyclotron resonance method.

The electrophotographic photosensitive members of the present invention possess low dark conductivity and sufficient photosensitivity so as to be practical, and also are superior in dark decay characteristics upon repeat operation.

Furthermore, according to the manufacturing method of the present invention, the photosensitive members of the present invention may be economically produced because of high deposition rate and high productivity.

PREFERRED EMBODIMENT OF THE INVENTION

Figure 1:
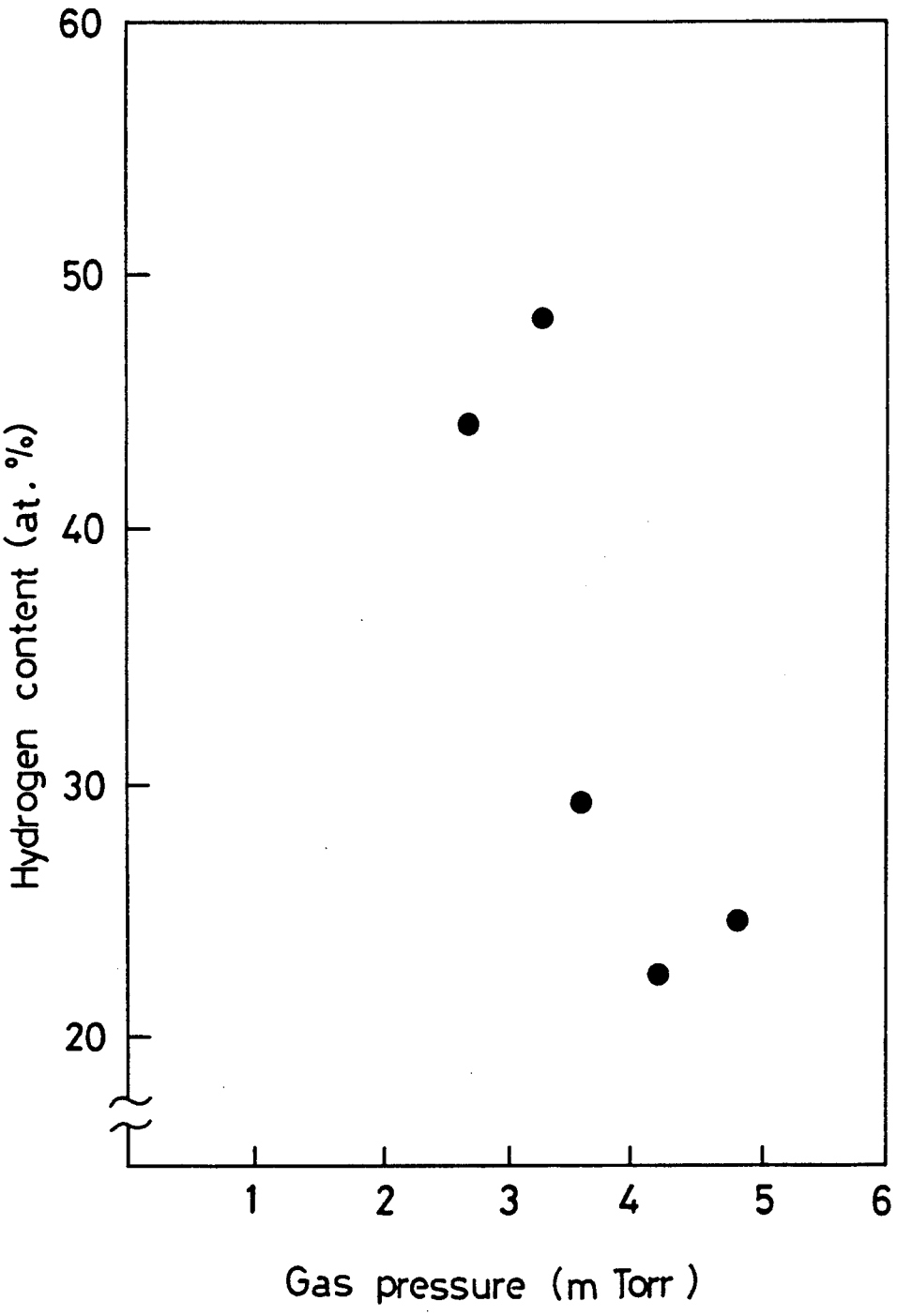
FIG. 1 illustrates the relationship between H content (atomic %) in a-SiN films fabricated by ECR method and gas pressure during deposition.

The electrophotographic photosensitive member of the present invention comprises basically a conductive substrate and a photoconductive layer but may provide an intermediate layer therebetween and a surface protecting layer on a free surface of the photoconductive layer.

As the conductive substrate, there may be used a conventional one available in the field, for example, a plate made from metals such as Al, Cr, Mo, Au, Ir, Nb, Ta, Pa, Pd and the like, or alloys from these metals. Also, the conductive substrate may be a film or a sheet made of synthetic resins such as polyesters, polyethylenes, cellulose acetate, polypropylenes and the like, and a sheet made of glass, ceramics, provided with a conductive layer on its surface. The substrate may have any shape suitable for the purpose, and is not limited to any particular configuration.

The photoconductive layer of the invention contains at least one chemical modifier chosen from C, N and 0 in amorphous silicon. N content with respect to Si atom is usually 0.01–28 atomic %, preferably 0.2–28 atomic %. C content with respect to Si atom is usually 5–30 atomic %, preferably 10–30 atomic %. And, O content with respect to Si atom is usually 5–20 atomic %, preferably 10–20 atomic %.

Also, the content of hydrogen and/or halogen in the photoconductive layer is preferably at least 40 atomic %, and 60 atomic % at maximum. Such films with high content of hydrogen and/or halogen may be prepared by ECR method. The films with derived content may be obtained mainly by adjusting gas pressure during deposition under the condition of the high microwave power of 2.5 kW and without heating the substrate. Usually, it is preferable that only hydrogen is contained in the photoconductive layer, but only halogen, or hydrogen with halogen may be contained.

The thickness of the photoconductive layer is usually 5–80 μm, preferably 10–50 μm.

To be noted is that the photoconductive layer may contain impurities such as P or B. Such impurities may control the dark conductivity and the carrier transport property, so that they may be added when necessary.

The intermediate layer serves to prevent the injection of carriers from the conductive substrate to the photoconductive layer, and may be provided as necessary. The intermediate layer is preferably formed by amorphous silicon and has usually a thickness of 2.0–20 μm.

The surface protecting layer may preferably be provided for protecting the photosensitive member from physical or chemical damages, such as corona discharge. The surface protecting layer may be amorphous silicon containing the same chemical modifier as that for the photoconductive layer, and may preferably use a-SiC whose film thickness is usually 0.2–10 μm.

ECR method is used for fabricating the photoconductive layer of the present invention.

Next, a film preparation method will be described in an example concerning formation of of a-SiN film.

The ECR plasma CVD equipment is composed of a plasma formation chamber and a specimen chamber. The plasma formation chamber includes a cavity resonator which is connected with the microwave source (a frequency of 2.45 GHz) through a rectangular waveguide, via microwave introducing window made from quartz. Around the plasma chamber, magnetic coils are provided, and they give the electron cyclotron resonance condition and form the divergent magnetic field, which extract the plasma stream to a substrate. The specimen chamber includes a conductive substrate. When the substrate is a cylindrical type, it is supported by a support member to thereby be rotatable. Into the specimen chamber is introduced a material gas of silicon compounds containing H or halogen, such as $SiH_4$, $Si_2H_6$, $SiF_4$, $SiCl_4$, $SiHCl_3$, $SiH_2Cl_2$, and the like, or mixtures of these material gases. Also, gas for supplying N effectively may include $NH_3$ or $N_2$ gas. First, the plasma formation chamber and specimen chamber are evacuated to vacuum so as to allow material gases to be introduced. In this instance, gas pressure is usually set at $10^{-3}$ Torr – $10^{-4}$ Torr. Then, into the plasma formation chamber is applied a magnetic field and then supplied a microwave power so as to excite plasma, which is directed to the substrate through a divergent magnetic field to cause a-SiN to be deposited. Since the support member is rotated, the film is uniformly deposited. The film uniformity can be improved by adjusting the position and the shape of plasma extracting orifice, which is arranged at the end opposite to the microwave introducing window.

By the deposition apparatus mentioned above, experiments have been made at some gas pressures with the material gases of $SiH_4$ and $NH_3$. In this case, the material gas flow rate is ($SiH_4+NH_3=120$ sccm), gases ratio is ($SiH_4/(SiH_4+NH_3)=0.96$), microwave power is 2.5 kW, and substrate is not heated.

Figure 2:
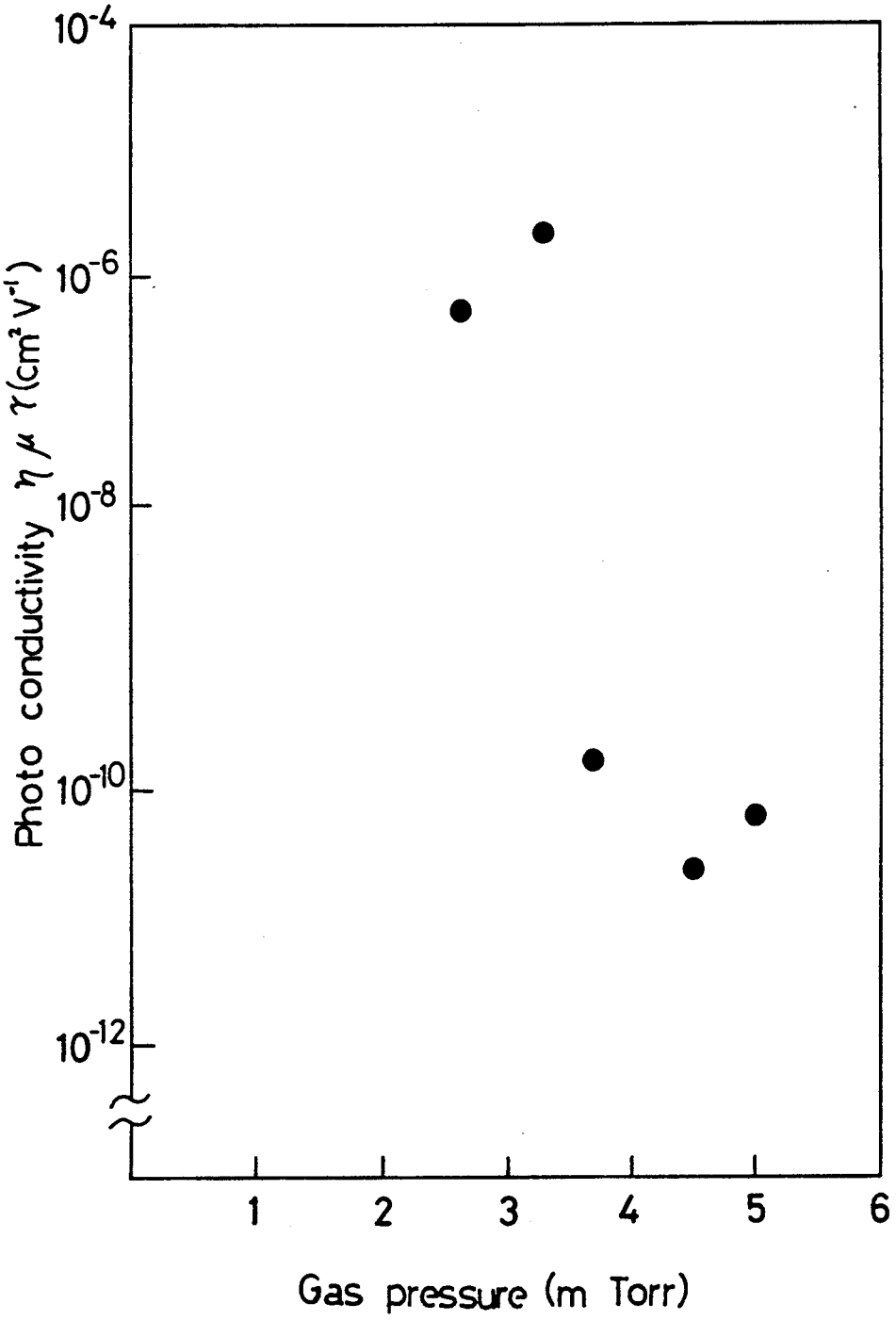
FIG. 2 illustrates the relationship between photoconductivity at 565 nm and gas pressure during deposition with respect to the a-SiN films of FIG. 1.
Figure 3:
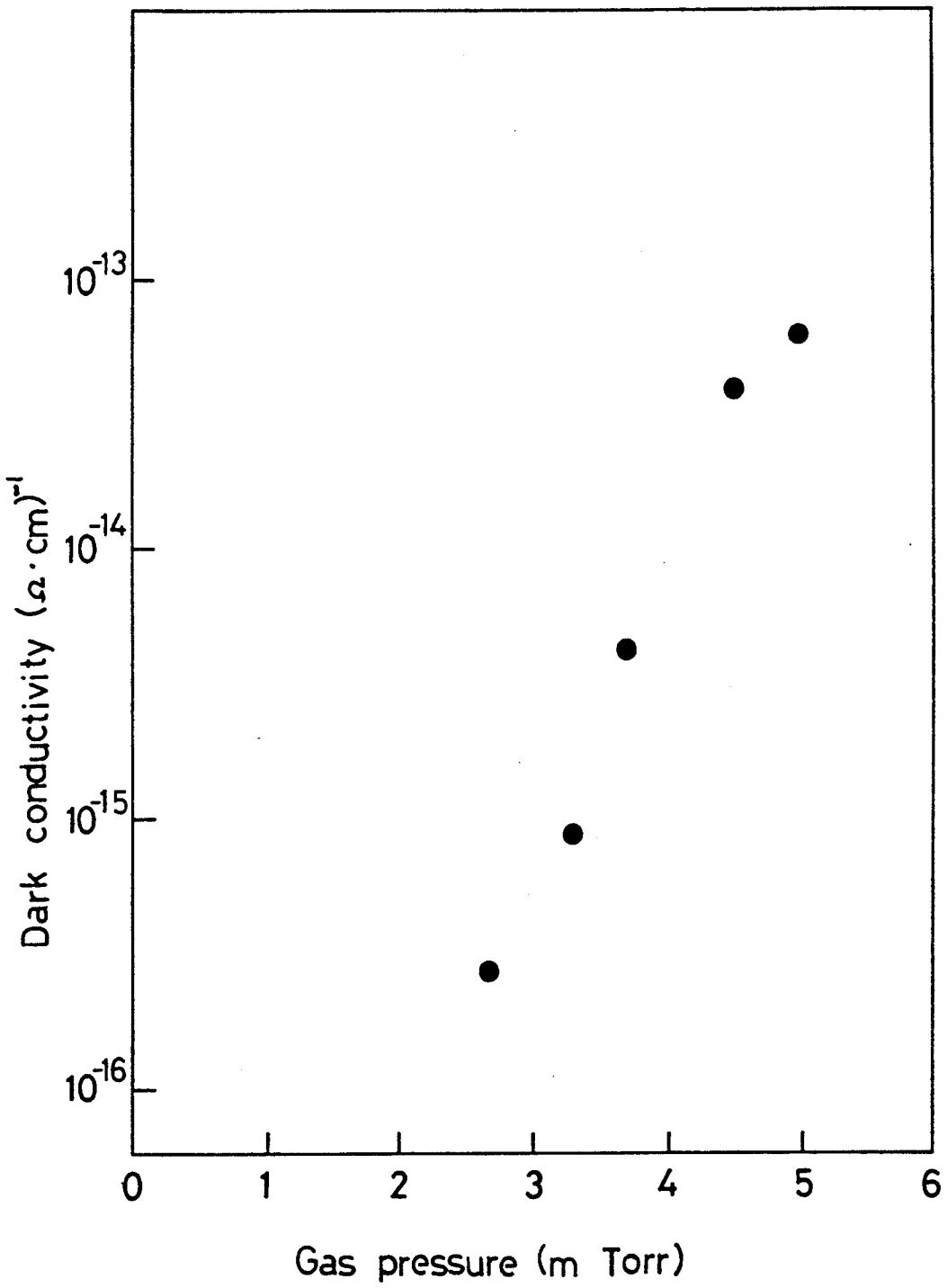
FIG. 3 illustrates the relationship between dark conductivity and gas pressure during deposition with respect to a-SiN films.

FIGS. 1, 2 and 3 show H content in the film, photoconductivity ($\eta\mu\tau$) at 565 nm, and dark conductivity ($\sigma_d$) dependent on gas pressure with respect to the obtained a-SiN films. As shown in FIG. 1–3, when the gas pressure is selected to provide a-SiN film with H content of more than 40 atomic %, the dark conductivity becomes less than $10^{-15}\Omega^{-1}cm^{-1}$ without being boron doped and the photoconductivity is high (photosensitivity is high). In the range where photoconductivity ($\eta\mu\tau$) becomes larger, the dark conductivity ($\sigma_d$) shows smaller. The dark conductivity is proportional to drift mobility $\mu$, so that in this region, it can be understood that lifetime $\tau$ becomes larger. It is well known that the $\tau$ and dangling bond density have a good correlation (i.e., when dangling bond density decreases, $\tau$ becomes larger). Hence, it was found that dangling bond density due to Si atom can be mainly reduced in the a-SiN film with H content of 40 or more atomic %, fabricated by ECR method. It is pointed out that the a-SiN film having less than $10^{-14}-10^{-15}\Omega^{-1}cm^{-1}$ of dark conductivity and in addition high photoconductivity (high photosensitivity) without doping of boron could not be obtained in the prior art, that is, the a-SiN films prepared by a conventional method could not reach the said characteristics.

In the method for fabricating the a-SiN films mentioned above, no formation of $(SiH_2)n$ powder is recognized. In this instance, the deposition rate and gas usage efficiency largely depend on gas pressure, so that gas pressure is selected to obtain a considerable higher (6–10 times higher) deposition rate and gas usage efficiency in comparison with the conventional art. Furthermore, it has been observed that at a specific gas pressure where H content becomes more than 40 atomic %, i.e., at gas pressure (2–3.5 m Torr) where it is possible to provide a-SiN film having dark conductivity more than $10^{-14}-10^{-15}\Omega^{-1}cm^{-1}$ and a high photoconductivity (high photosensitivity), the deposition rate and gas usage efficiency preferably show a higher value. On the contrary, a-SiN films deposited by a conventional method generally have such tendency that photosensitivity is deteriorated in the range of higher deposition rate. Also in this respect, the present invention has a superior feature to those in the conventional art.

It is natural that when a silicon compound containing halogen is introduced as material gas, it requires that a total amount of H and halogen in the film is more than 40 atomic %. From additional experiments, it has been observed that when the amount of H and/or halogen in the film is set to be more than 60 atomic %, optical band gap of the film becomes too larger, so that this feature is not suitable for photoconductive layer for electrophotographic photosensitive member requiring photosensitivity with respect to visible light. In detail, a relevant content of H and/or halogen in the film is 40–60 atom %, preferably 43–55 atomic %.

Next, it has been observed that when the H content in the film is fixed in a range of 43–46 atomic % and a gaseous ratio of $SiH_4$ and $NH_3$ is changed to vary N content in the film. In the case of N content less than 0.01 atomic %, there is no effect of decrease in the dark conductivity. It is considered that nitrogen acts as a donor and it causes the dark conductivity to be larger. Therefore, in this region, a-SiN films are not proper for a photoconductive layer for electrophotographic photosensitive member. Also, in the case of N content more than 28 atomic %, the photosensitivity to visible light is drastically lowered, which feature is also not suitable for a photoconductive layer for electrophotographic photosensitive member. In other words, a usual value of N content with respect to Si atom is to be 0.01–28 atomic % preferably 0.2–28 atomic %.

Next, the details of a-SiC film and a-SiO film will be described. The preparation apparatus to be used is the same as that for the a-SiN films. Material gases to be introduced are silicon compounds containing H or halogen such as $SiH_4$, $Si_2H_6$, $SiF_4$, $SiCl_4$, $SiHCl_3$, $SiH_2Cl_2$, and the like, or a mixture of these material gases. Also, gases for C source may be such as $CH_4$, $C_2H_6$ or $C_2H_4$, and gases for O source may be $CO_2$, $N_2O$ or $O_2$.

FIGS. 4–9 show H content in the film, photoconductivity ($\eta\mu\tau$) at 565 nm, dark conductivity ($\sigma_d$) dependent on gas pressure during deposition for a-SiC films and a-SiO films. The preparation conditions for these films are as follows. For a-SiC films, $SiH_4+CH_4=145$ sccm, $SiH_4/(SiH_4+CH_4)=0.83$, microwave power=2.5 kW, and the substrate is not heated. In the case of a-SiO films, $SiH_4+O_2=145$ sccm, $SiH_4/(SiH_4+O_2)=0.83$, microwave power=2.5 kW, and the substrate is not heated. As seen from FIGS. 4–9, similarly with the a-SiN films, only when gas pressure is selected to set H content to be more than 40 atomic %, is it possible to provide a sufficient photoconductivity ($\eta\mu\tau$) and dark conductivity ($\sigma_d$) for an electrophotographic photosensitive member.

Figure 10:
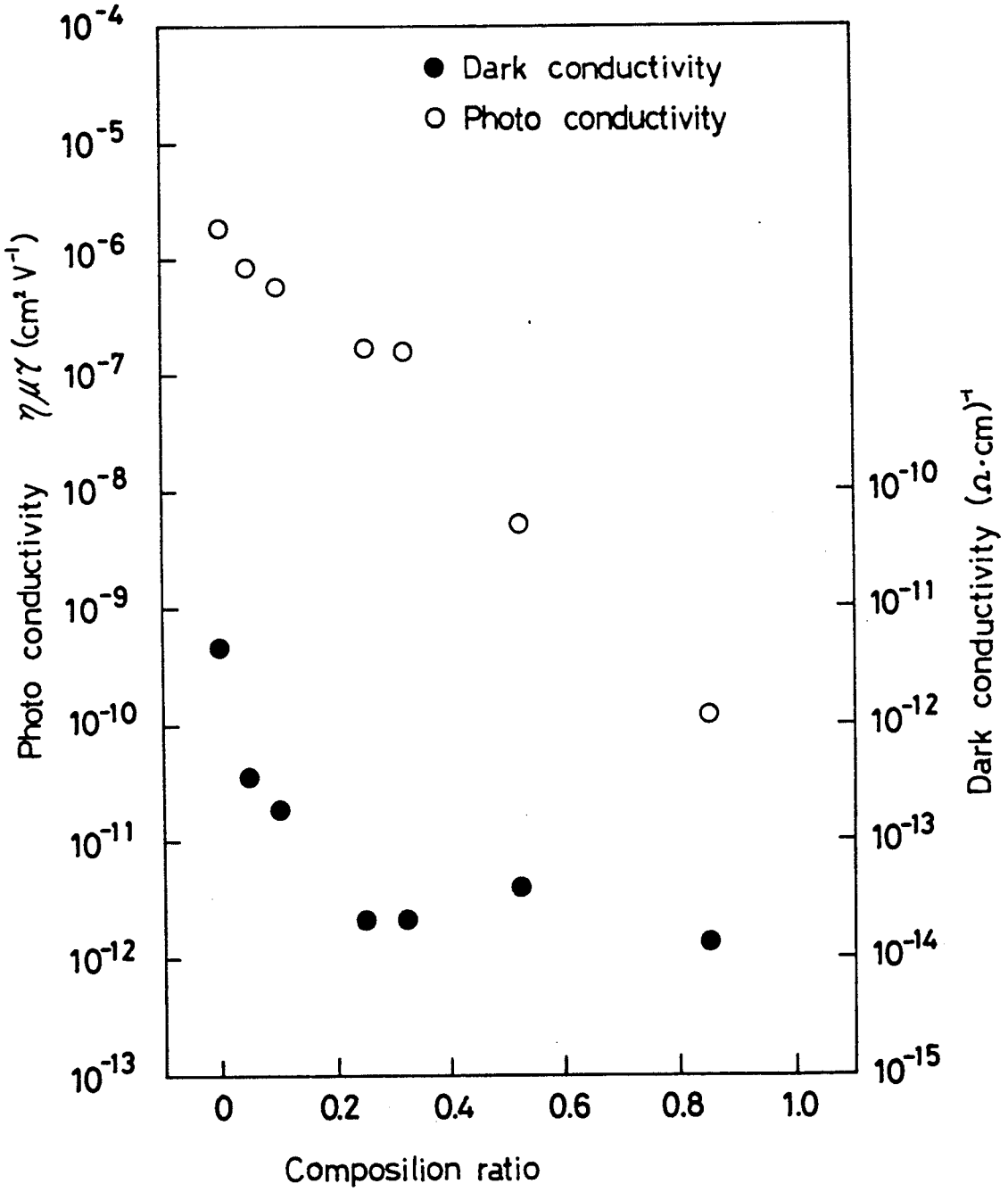
FIG. 10 illustrates the relationships between the film composition, i.e., the atomic ratio of Si atom to C atom and photo conductivity and dark conductivity, with respect to a-SiC films by ECR method.
Figure 11:
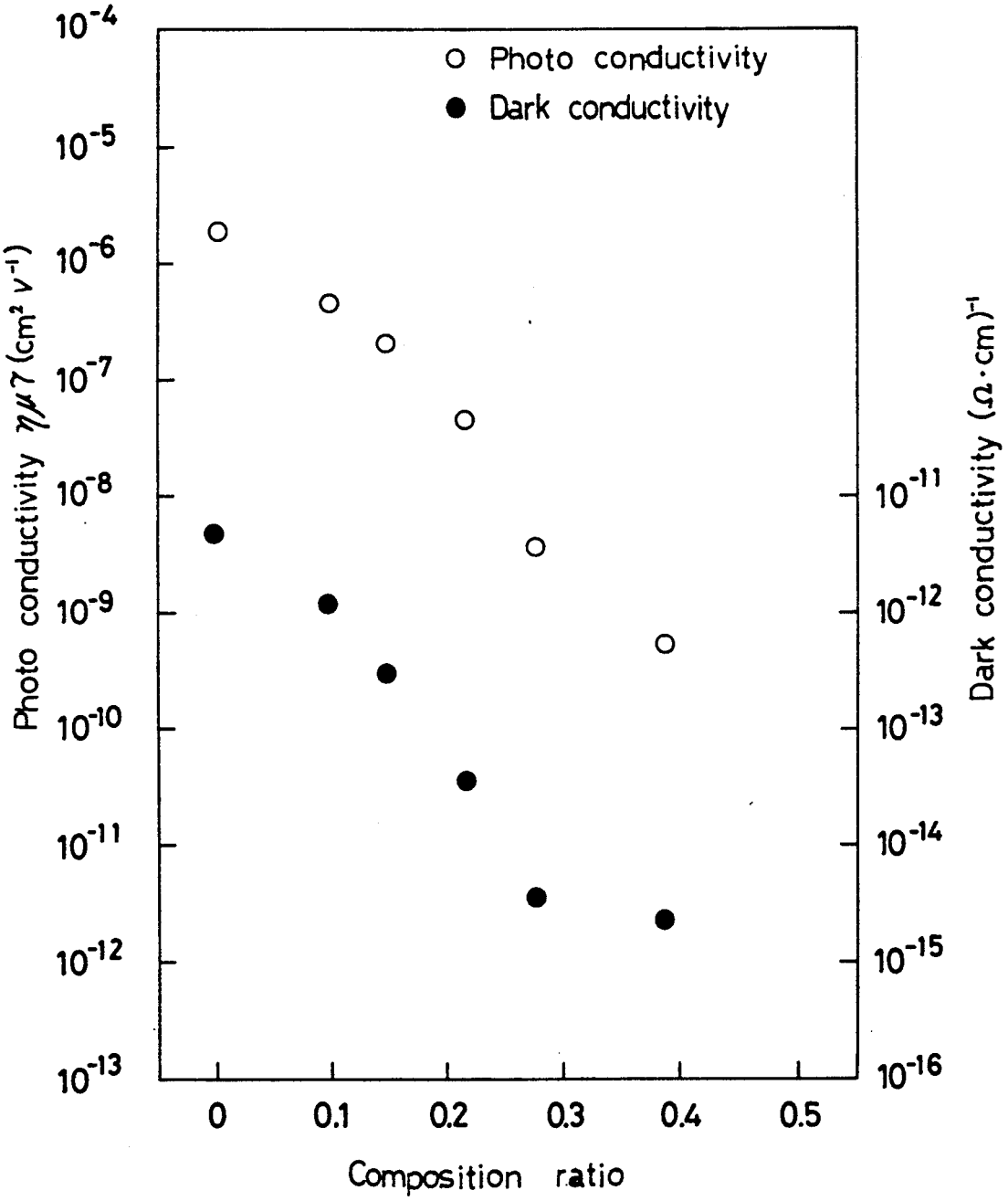
FIG. 11 illustrates the relationships between the film composition, i.e., the atomic ratio of Si atom to O atom and photoconductivity and dark conductivity, with respect to SiO films by ECR method.

FIGS. 10 and 11 show the relationships between photo conductivity ($\eta\mu\tau$), and dark conductivity ($\sigma_d$), and the film composition of a-SiC films or a-SiO films which were prepared in varying the flow rates of $SiH_4$ and $CH_4$, or $SiH_4$ and $O_2$, respectively. The other preparation conditions are the same as those of the films shown in FIGS. 4–9 except for gas pressure fixed at 3.0 m Torr.

As seen in FIGS. 4–9, in the a-SiC films and a-SiO films with low dark conductivity and high photoconductivity, the content of H and/or halogen is to be 40–60 atomic %. To be noted is that when H content is more than 60 atomic %, H is bonded with Si in polymeric configuration of $(SiH_2)_n$ to thereby deteriorate photoconductivity. The H and/or halogen content in these films is preferably 43–55 atomic %. From FIG. 10, in the SiC films with C content more than 30 atomic %, photoconductivity ($\eta\mu\tau$) shows less than $10^{-7}$ $cm^2/v$, and less than 5 atomic %, dark conductivity ($\sigma_d$) is not drastically changed in comparison with that of the film with no C content. Films with such characteristic are the object of the present invention. In other words, the C content in the a-SiC films is to be 5–40 atomic %, preferably 10–30 atomic %. Also, from FIG. 11, the O content in the a-SiO films is to be 5–25 atomic %, preferably 10–20 atomic %, for the same reason mentioned above for C content.

The photoconductive films according to the present invention are most suitably usable for a photosensitive device adapted to convert optical informations to electrical signals, such as those provided in electrophotography, image sensor or display in a coupled configuration with a liquid crystal. The invention is also applicable to such a device a solar battery, or a thin film transister.

Next examples are given for the embodiments of the preparation of a-SiN film; a-SiC film, a-SiO film having H and/or halogen content at more than 40 atomic % in the film and their use in a photoconductive layer of an electrophotographic photosensitive member.

EXAMPLE 1

A cylindrical conductive substrate made of Al is mounted in the specimen chamber. $SiH_4$ gas of 120 sccm and $B_2H_6$ gas of 20 sccm (diluted by $H_2$ to 3000 ppm) are fed into the specimen chamber, so that an intermediate layer comprised of a-Si of 2.5 μm thickness is fabricated on the conductive substrate by ECR method under the condition of gas pressure of 3.0 m Torr and microwave power of 2.5 kW.

Then, into the specimen chamber is introduced $SiH_4$ gas of 115 sccm, $NH_3$ gas of 5 sccm, $B_2H_6$ gas of 12.5 sccm (diluted by $H_2$ to 30 ppm), so that a photoconductive layer comprised of a-SiN of 28 μm thickness is fabricated by ECR method under the condition of gas pressure of 3.2 m Torr and microwave power of 2.5 kW.

Furthermore, into the specimen chamber is introduced $SiH_4$ gas of 30 sccm and $CH_4$ gas of 1000 sccm, so that a surface protecting layer comprised of a-SiC of 0.3 μm thickness is prepared by ECR method under the condition of gas pressure of 3.0 m Torr and microwave power of 2.5 kW.

The N content (N/Si) and the hydrogen content in the a-SiN photoconductive layer is 11 atomic % and 48 atomic %, respectively.

In the preparation process of the electrophotographic photoreceptor, there is no formation of polymeric powder of $(SiH_2)_n$, and deposition rate and gas usage efficiency have a considerably higher (6–10 times higher) value in comparison with those in the conventional art. Additionally, the obtained electrophotographic photo receptor showed a superiority in dark decay characteristics, particularly upon repeat operation. Furthermore, the electrophotographic photoreceptor was evaluated in a commercially available duplicator and provided a favourable image quality.

EXAMPLE 2

Figure 4:
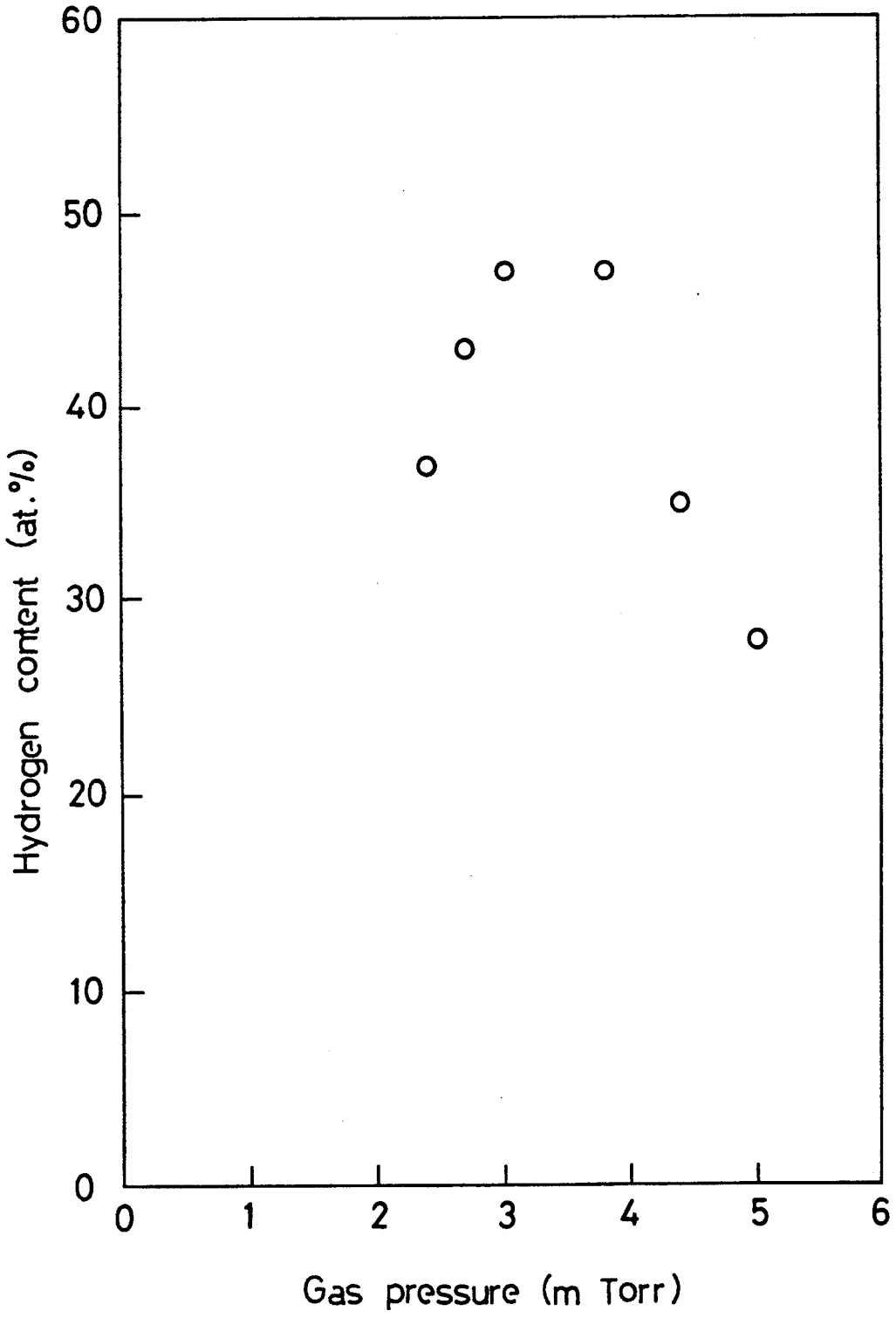
FIGS. 4-6 illustrates the relationships between gas pressure during the deposition of a-SiC film by ECR method, and hydrogen content, photoconductivity at 565 nm or dark conductivity, respectively.
Figure 5:
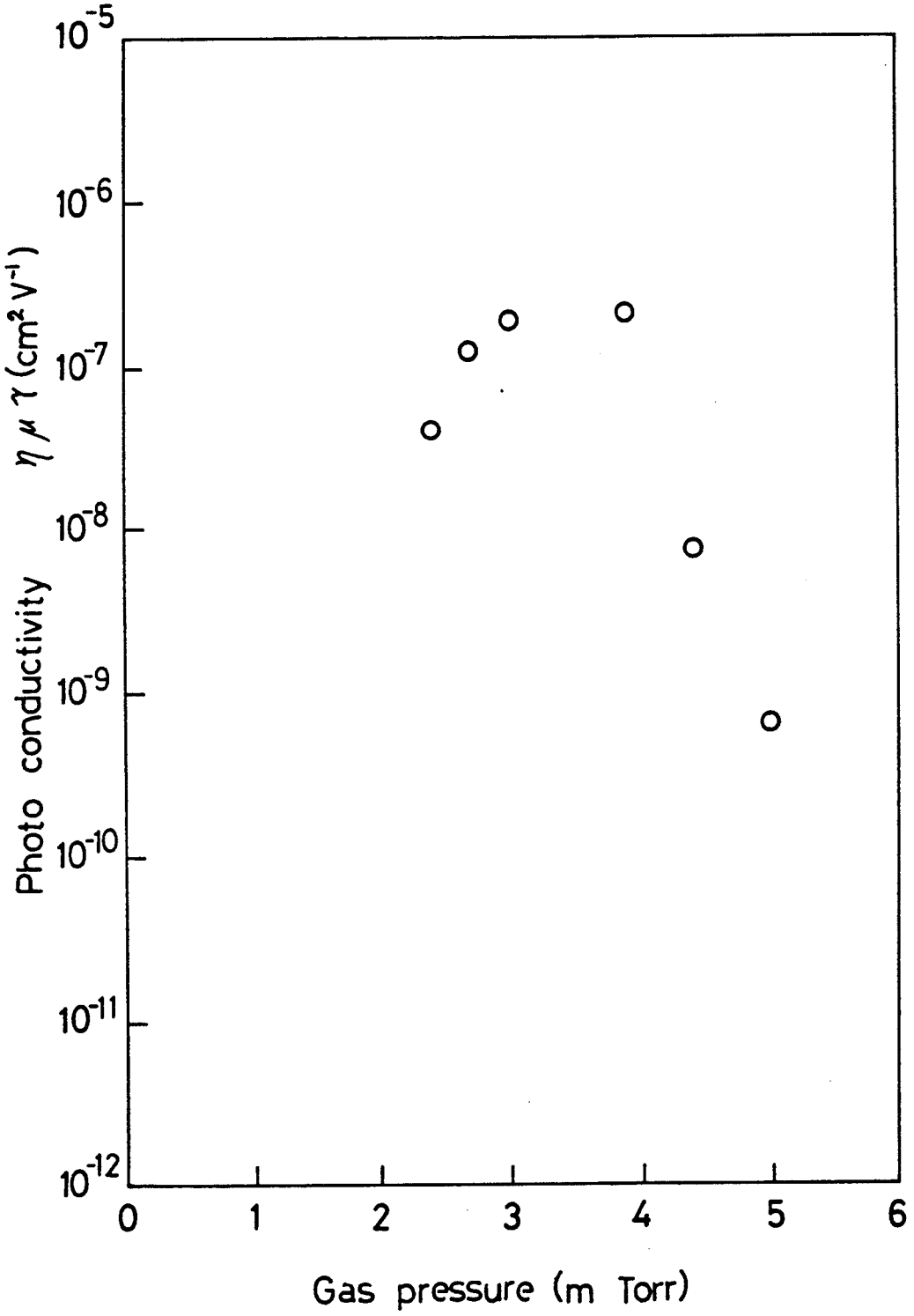
Figure 6:
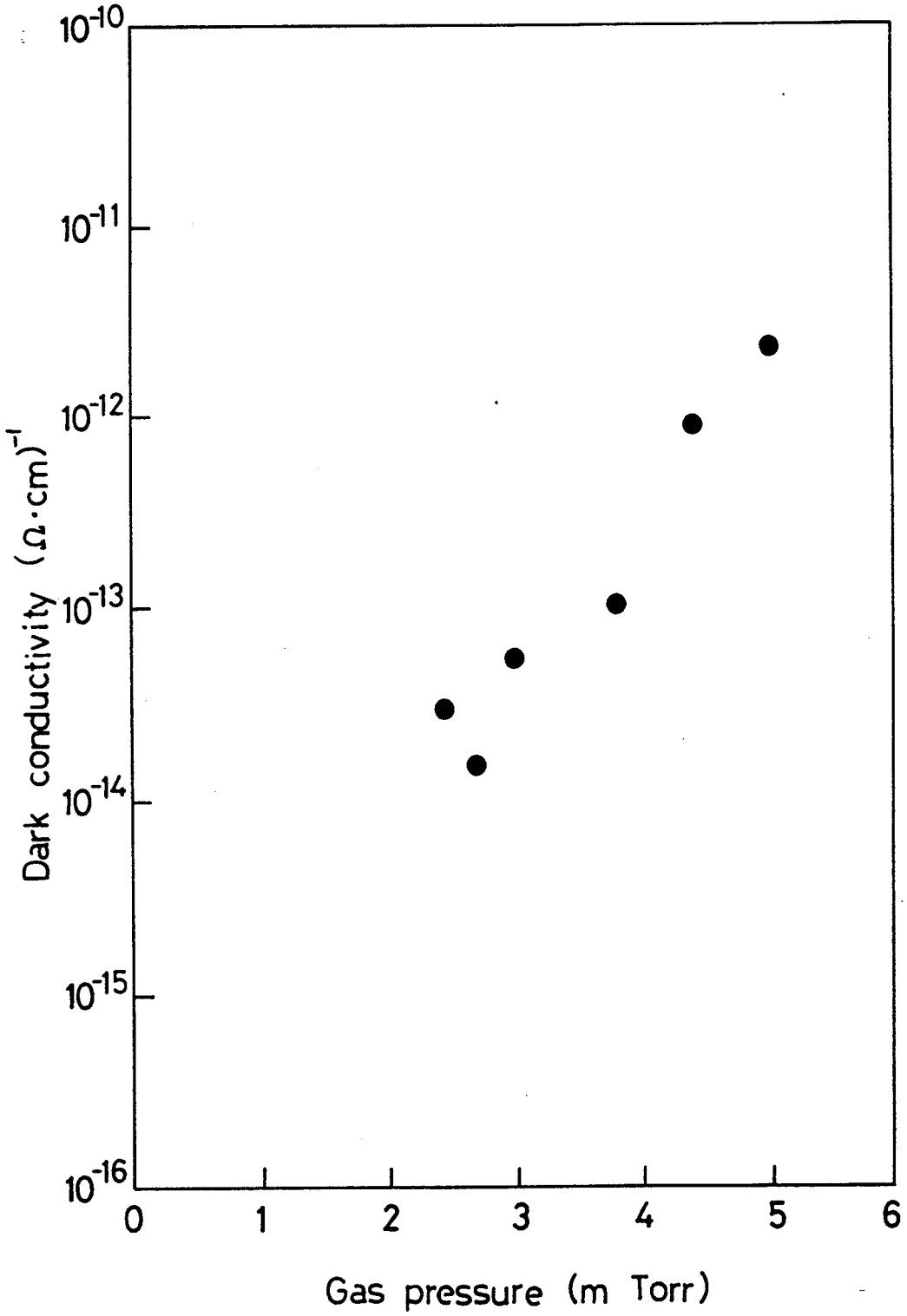
Figure 7:
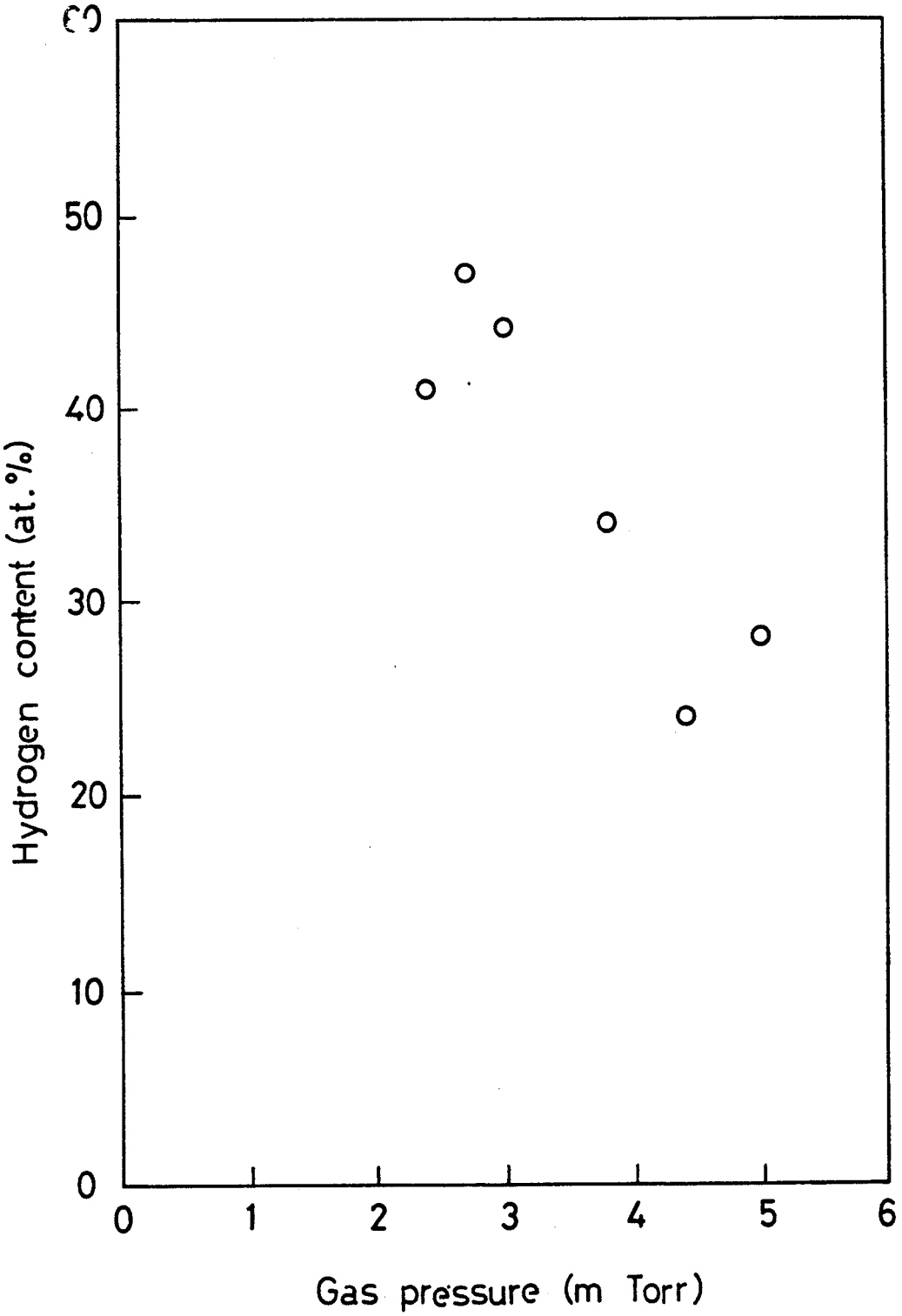
FIGS. 7-9 illustrates the relationships between gas pressure during the deposition of a-SiO films and hydrogen content, photoconductivity at 565 nm or dark conductivity, respectively.
Figure 8:
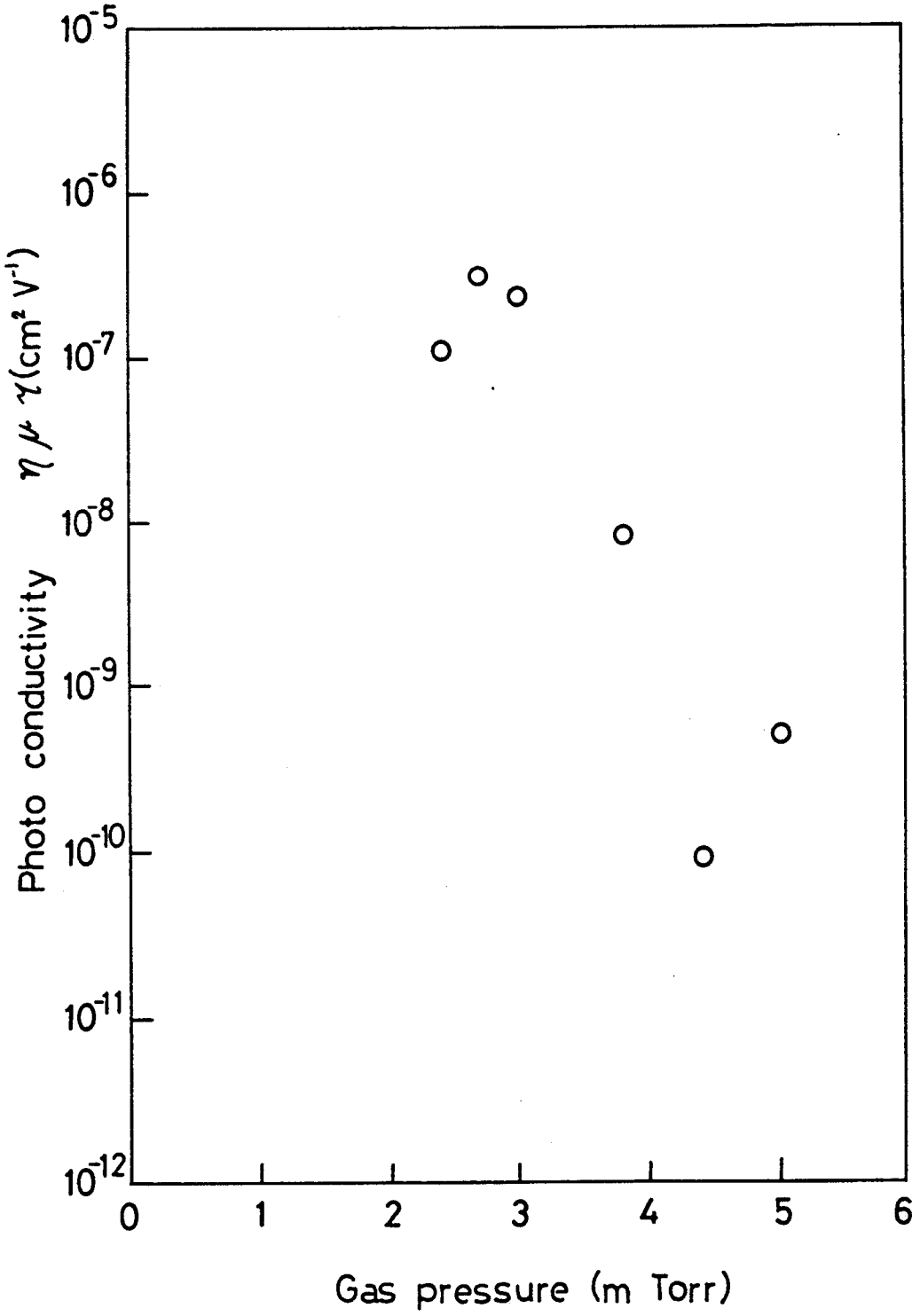
Figure 9:
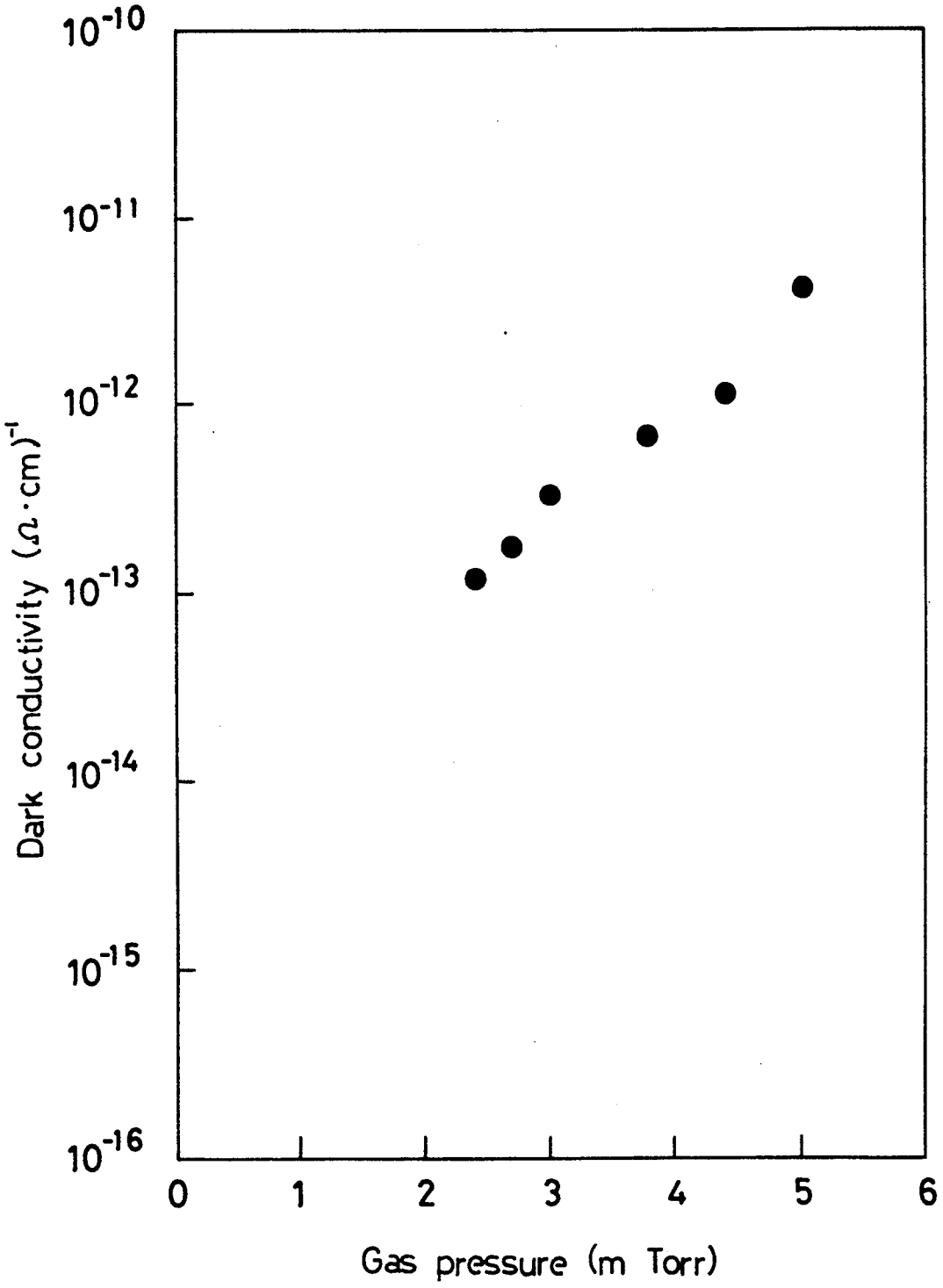

Under the same preparation conditions as that used in the example 1 except that gas pressure is changed to 2.7, 3.3, 3.6, 4.2 and 4.8 m Torr upon fabrication of a-SiN photoconductive layer, that is, five electrophotographic photoreceptors were made. Table 1 shows the results of the image quality and the dark decay characteristics upon repeat operation for the obtained five electrophotographic photoreceptors (with ◎ being excellent; Δ being poor; and X being no good). Also, the hydrogen content, photoconductivity and dark resistivity of the photoconductive layers dependent on gas pressure are as shown in FIGS. 3, 4 and 5. As shown in these figures, at gas pressure of 2.7 m Torr and 3.3 m Torr, an excellent electrophotographic photosensitive members can be obtained, wherein hydrogen content in the photoconductive layers is more than 40 atomic %. In this instance, N content (N/Si) was 9–12 atomic %.

TABLE 1

| Gas pressure | 2.7 | 3.3 | 3.6 | 4.2 | 4.8 |
|---|---|---|---|---|---|

TABLE 1-continued

| | | | | | |
|---|---|---|---|---|---|
| (m Torr) | | | | | |
| Dark decay characteristics | ● | ● | Δ | X | X |
| Image quality | ● | ● | X | X | X |

EXAMPLE 3

Under the same preparation conditions as that in the example 1 except that phosphorus in place of boron is doped into the photoconductive layer and the intermediate layer, a negative charge electrophotographic photoreceptor was made. The flow rates of $PH_3$ upon the fabrication of the intermediate layer and photoconductive layer are 1.5 sccm (diluted by $H_2$ to 3000 ppm) and 1.2 sccm (diluted by $H_2$ to 30 ppm), respectively.

Measurement of the obtained electrophotographic photoreceptor showed a superiority in dark decay characteristics particularly upon repeat operation. Also, the photoreceptor was evaluated in a commercially available duplicator for negative charge and could provide a favourable image quality.

EXAMPLE 4

An intermediate layer comprised of a-Si with 2.5 μm thickness was fabricated on the cylindrical conductive support member made of Al by ECR method under such conditions as microwave power of 2.5 kW, gas pressure of 2.7 m Torr and $SiH_4$ gas of 120 sccm, $B_2H_6$ gas of 22 sccm (diluted by $H_2$ to 3000 ppm), and NO gas of 12 sccm.

Then, a photoconductive layer comprised of a-SiC with 28 μm thickness was made on the intermediate layer by ECR method under such conditions as microwave power of 2.5 kW, gas pressure of 2.7 m Torr and $SiH_4$ gas of 120 sccm, $CH_4$ gas of 25 sccm and $B_2H_6$ gas of 40 sccm (diluted by $H_2$ to 30 ppm).

Furthermore, a surface layer comprised of a-SiC with 0.3 μm thickness was fabricated on the photoconductive layer under such conditions as microwave power of 1.5 kW, gas pressure of 0.8 m Torr and $SiH_4$ gas of 10 sccm and $CH_4$ gas of 18 sccm, whereby an electrophotographic photoreceptor could be obtained.

In the case, this carbon content in the photoconductive layer was 20 atomic %, and the hydrogen content was 43 atomic %. Also, it was found that the deposition rate for the photoconductive layer was about 23 μm/hour which notably improved in comparison with the case of that (about 10 μm/hour) of the conventional plasma CVD method. Upon the preparation process, the conductive support member was not heated and there was observed no formation of polymeric powder of $(SiH_2)_n$. Measurement of the obtained electrophotographic photoreceptor for positive charge showed a favourable photosensitivity, less amount of residual potential, and is superior particularly in dark decay characteristics. Also, the electrophotographic photoreceptor was evaluated in a commercially available duplicator for positive charge and could provide a favourable image quality without having fogging.

EXAMPLE 5

Under the same preparation conditions as that in the Example 4 except that $O_2$ gas of 25 sccm in place of $CH_4$ gas was introduced upon the fabrication of a-SiO photoconductive layer by ECR method, an electrophotographic photoreceptor was made. In the a-SiO photoconductive layer, the oxygen content was 12 atomic %, and the hydrogen content was 47 atomic %. In this case, the deposition rate was 23 μm/hour. Measurement of the obtained electrophotographic photoreceptor for positive charge showed the same results as in the Example 5, that is, it has a favourable photosensitivity, less residual potential and is superior in dark decay characteristics. Furthermore, the electrophotographic photoreceptor was evaluated in a commercially available duplicator for positive charge and could provide a favourable image quality without having fogging.

EXAMPLE 6

Under the same preparation conditions as that in the Example 4 except that $PH_3$ gas of 12 sccm (diluted by $H_2$ to 2000 ppm) in place of $B_2H_6$ gas was introduced upon the fabrication of the intermediate layer and $B_2H_6$ gas was not introduced upon the fabrication of the photoconductive layer, an electrophotographic photoreceptor was made. Measurement of the obtained electrophotographic photoreceptor for negative charge showed that it has a favourable photosensitivity, less residual potential and is superior particularly in dark decay characteristics, as the same results in the Example 5 except for polarity. Furthermore, the electrophotographic photoreceptor was evaluated in a commercially available duplicator for negative charge and could provide a favourable image quality without having fogging.

EXAMPLE 7

Under the same preparation conditions as that in the Example 5 except that $PH_3$ gas of 12 sccm (diluted by $H_2$ to 2000 ppm) in place of $B_2H_6$ gas was introduced upon the fabrication of the intermediate layer and $B_2H_6$ gas was not introduced upon the fabrication of the photoconductive layer, an electrophotographic photoreceptor was made. Measurement of the obtained electrophotographic photoreceptor showed that it has a favourable photosensitivity, less residual potential and is superior particularly in dark decay characteristics, as the same results in the Example 5 except for polarity. Furthermore, the electrophotographic photoreceptor was evaluated in a commercially available duplicator for negative charge and could provide a favourable image quality without having fogging.

What is claimed is:

1. A photosensitive member for electrophotography comprising a conductive substrate and a photoconductive layer comprising an amorphous silicon containing 40–60 atomic % of a member selected from the group consisting of hydrogen, halogen and mixtures thereof, and at least one chemical modifier selected from the group consisting of carbon at 5–40 atomic %, nitrogen at 0.01–28 atomic %, and oxygen at 5–25 atomic %, each based on silicon, with said amorphous silicon being deposited utilizing an electron resonance method.

2. The photosensitive member according to claim 1, wherein said amorphous silicon contains hydrogen at 43–55 atomic %.

3. The photosensitive member according to claim 1, further comprising an intermediate layer between said conductive substrate and said photoconductive layer.

4. The photosensitive member according to claim 3, wherein said photoconductive layer has a free surface, and further comprising a surface layer over said free surface of said photoconductive layer.

5. The photosensitive member according to claim 1, wherein said conductive substrate comprises an aluminum plate.

6. A process for manufacturing a photosensitive member for electrophotography comprising depositing by electron cyclotron resonance a photoconductive layer of amorphous silicon on a conductive substrate under conditions to obtain within said photoconductive layer a member selected from the group consisting of hydrogen, halogen and mixtures thereof in said photoconductive layer at 40–60 atomic %, and at least one chemical modifier selected from the group consisting of carbon, nitrogen and oxygen.

7. The process for manufacturing a photosensitive member according to claim 6, wherein said amorphous silicon is deposited under conditions to obtain hydrogen in said photoconductive layer at 43–55 atomic %.

8. The process for manufacturing a photosensitive member according to claim 6, wherein said amorphous silicon is deposited under conditions to obtain nitrogen in said photoconductive layer at 0.1–28 atomic %, based on silicon.

9. The process for manufacturing a photosensitive member according to claim 6, wherein said amorphous silicon is deposited under conditions to obtain carbon in said photosensitive layer at 5–40 atomic %, based on silicon.

10. The process for manufacturing a photosensitive member according to claim 6, wherein said amorphous silicon is deposited under conditions to obtain oxygen in said photoconductive layer at 5–25 atomic %, based on silicon.

11. The process for manufacturing a photosensitive member according to claim 6, further comprising depositing an intermediate layer between said conductive substrate and said photoconductive layer.

12. The process for manufacturing a photosensitive member according to claim 11, wherein said photoconductive layer has a free surface, and further comprising depositing a surface layer over said free surface of the photoconductive layer.

13. The process for manufacturing a photosensitive member according to claim 6, wherein said conductive substrate comprises an aluminum plate.

14. A product produced by the process of claim 6.

15. A product produced by the process of claim 7.

16. A product produced by the process of claim 8.

17. A product produced by the process of claim 9.

18. A product produced by the process of claim 10.

* * * * *

UNITED STATES PATENT AND TRADEMARK OFFICE

CERTIFICATE OF CORRECTION

PATENT NO. : 5,009,977

DATED : April 23, 1991

INVENTOR(S) : T. HAYAKAWA et al.

It is certified that error appears in the above-indentified patent and that said Letters Patent is hereby corrected as shown below:

Title page, item [57], line 4, change ";" to ---,---.

Column 1, line 20, change "photoreceptor" to ---photoreceptors---.

Column 1, line 21, after "are" insert ---harmless---.

Column 1, line 21, after "have" insert ---high---.

Column 1, line 31, after "by" insert ---doping---.

Column 1, line 32, after "usable" insert ---for--.

Column 1, line 55, change "to yield" to ---the formation of---.

Column 1, line 55, after "($SiH_2$)" insert ---$_n$---.

Column 4, line 35, change "($SiH_2$)n" to ---($SiH_2$)$_n$---.

Column 5, line 43, after "4-9" insert ---,---.

Column 5, line 57, change "characteristic" to ---characteristics---.

Column 6, line 40, change "photo" to ---photo- ---.

Column 7, line 44, change "the" to ---this---.

Signed and Sealed this

Twenty-second Day of November, 1994

*Attest:*

Bruce Lehman

BRUCE LEHMAN

*Attesting Officer*

*Commissioner of Patents and Trademarks*